US006234576B1

(12) United States Patent
Fleigle

(10) Patent No.: US 6,234,576 B1
(45) **Date of Patent: *May 22, 2001**

(54) UNIVERSAL WHEELCHAIR FOOTREST BRACKET ASSEMBLY

(75) Inventor: Donald E. Fleigle, Ventura, CA (US)

(73) Assignee: Sunrise Medical HHG Inc., Longmont, CO (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/088,277

(22) Filed: Jun. 1, 1998

(51) Int. Cl.[7] ..... A47C 16/00
(52) U.S. Cl. ..... 297/423.37; 297/DIG. 4
(58) Field of Search ..... 297/423.4, 423.25, 297/423.37, 423.35, 440.1, DIG. 4; 280/250.1

(56) References Cited

U.S. PATENT DOCUMENTS

| | | | |
|---|---|---|---|
| 2,841,208 | * | 7/1958 | Duke . |
| 2,868,275 | * | 1/1959 | Mize . |
| 3,453,027 | * | 7/1969 | Pivacek . |
| 3,482,873 | | 12/1969 | Pivacek . |
| 3,672,722 | | 6/1972 | Murcott . |
| 3,854,774 | | 12/1974 | Limpach . |
| 3,857,606 | | 12/1974 | Rodaway . |
| 3,883,175 | | 5/1975 | Rodaway . |
| 4,722,572 | * | 2/1988 | Sata . |
| 4,813,693 | | 3/1989 | Lockard et al. . |
| 4,981,305 | * | 1/1991 | Lockard et al. . |
| 4,988,114 | | 1/1991 | Thornton, Jr. et al. . |
| 5,209,509 | | 5/1993 | Gay et al. . |
| 5,393,082 | | 2/1995 | Fenley . |
| 5,401,045 | | 3/1995 | Foerster et al. . |

* cited by examiner

*Primary Examiner*—Milton Nelson, Jr.
(74) *Attorney, Agent, or Firm*—MacMillan, Sobanski & Todd, LLC

(57) ABSTRACT

A universal swing-away detachable footrest bracket assembly for a wheelchair. The footrest bracket assembly includes an upper footrest tube assembly including an upper support plate mounted on a frame tube of the wheelchair, a lower support plate mounted on the frame tube in a vertically aligned, spaced-apart relationship with the upper support plate, an upper footrest support member having an upper flange and a lower flange in a vertically aligned, spaced-apart relationship with the upper flange. The upper and lower flanges are capable of being pivotally mounted on the upper support plate and the lower support plate, respectively. The footrest bracket assembly also includes a lower footrest tube assembly including a lower footrest support member connected to the upper footrest support member, an outwardly extending tube frame connected to a lower end of the lower footrest support member, and a footrest removably attached to the tube frame. The footrest bracket assembly is capable of being positioned on either the left or right side of the wheelchair by pivotally mounting the upper footrest tube assembly to the frame tube of the wheelchair.

15 Claims, 4 Drawing Sheets

UNIVERSAL WHEELCHAIR FOOTREST BRACKET ASSEMBLY

BACKGROUND OF THE INVENTION

This invention relates in general to a wheelchair, and in particular, to a wheelchair footrest bracket assembly capable of being used on either side of the wheelchair.

The use of detachable wheelchair footrests is well known in the art. For example, U.S. Pat. No. 3,857,606 to Rodaway discloses a swing-away footrest no bracket having an upwardly facing lower collar and a downwardly facing upper collar that are attached to each front frame member on the wheelchair. A saddle member is inserted into the upper collar, rotated to abut the front frame member, and lowered into the lower collar to attach the footrest bracket. A spring-loaded latch engages a notch in the upper collar to lock the footrest. A detachable wheelchair footrest allows the occupant to maneuver the wheelchair in smaller places with a minimum amount of effort.

However, many of the prior art devices utilize rather complicated mechanisms for the removal and replacement of the footrest. In addition, all existing wheelchair footrests have a left and right footrest for the respective side of the wheelchair. These "handed" footrests have many parts unique to the left or right side of the wheelchair. Further, the attachment points and the hangers for the footrest are also unique for the left or right side of the wheelchair. As a result, the wheelchair supplier or health care provider is required to manufacture, assemble, and stock parts that are unique to the left and right side of the wheelchair, thereby increasing the cost of manufacturing the wheelchair and creating an inventory problem for the wheelchair dealer or healthcare provider. Accordingly, it is desirable to provide an universal wheelchair footrest assembly that can be used for either the left or right side of the wheelchair.

SUMMARY OF THE INVENTION

This invention relates to a universal footrest assembly that connects to a wheelchair. An upper support plate is mounted on a front tubular member of the wheelchair. The upper support plate includes a first pivot pin. A lower support plate is mounted on the front tubular member in a spaced-apart, vertically-aligned relationship with the upper support plate. The lower support plate includes a second pivot pin and a pair of latch pins. A footrest support member has an upper pivot flange with at least one pivot hole and a lower pivot flange with at least one pivot hole. The pivot hole of the first pivot plate is capable of being received in the first pivot pin of the upper support plate and the pivot hole of the lower pivot flange is capable of being received in the second pivot pin of the lower support plate for pivotally mounting the footrest support member to the upper and lower support plates. A latch mechanism includes a pair of spring-biased latch members. Each latch member has a latch seat for cooperating with the pair of latch pins on the lower support plate. Each latch member also includes a front cam surface and a rear cam surface. The footrest assembly is in a locked position when the latch seat of each latch member engages the pair of latch pins of the lower support. The footrest assembly is in an unlocked position and can be swung away and detached from the wheelchair when at least one latch seat does not engage at least one latch pin of the lower support plate.

Various objects and advantages of this invention will become apparent to those skilled in the art from the following detailed description of the preferred embodiment, when read in light of the accompanying drawings.

DETAILED DESCRIPTION OF THE PREFERRED EMBODIMENT

Figure 1:
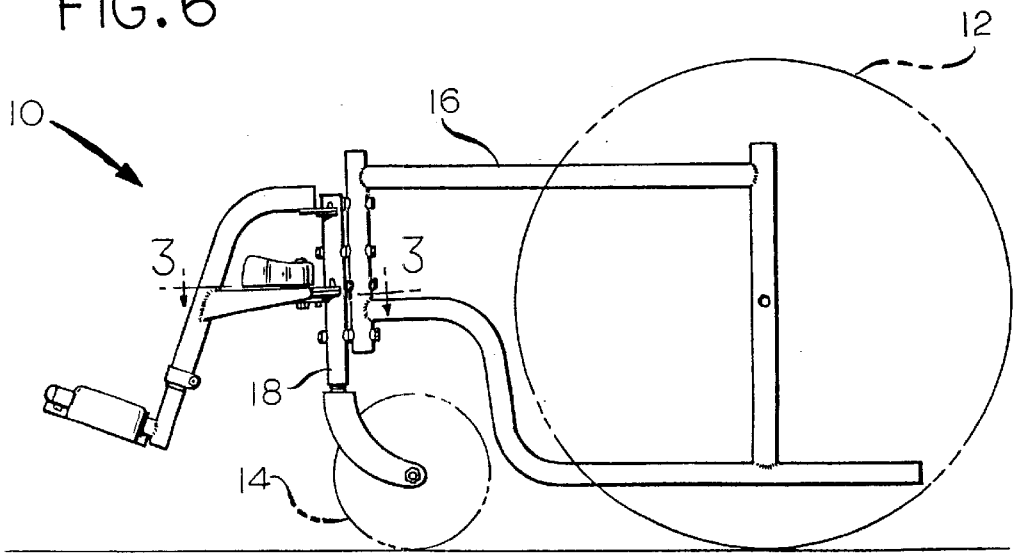
FIG. 1 is a side view of a portion of a wheelchair shown in partial phantom including a universal footrest assembly shown in a locked position on one side of the wheelchair.

Referring now to the drawings, there is illustrated in FIG. 1 a universal footrest bracket assembly, shown generally at 10, according to a preferred embodiment of the invention. Typically, each side of a wheelchair (shown in phantom) includes a large rolling support wheel 12, a small front guide wheel 14, and a frame member 16. The large support wheels 12 are usually rotatably attached to the frame member 16 in a manner well-known in the art. It should be noted that FIG. 1 illustrates the left side of the wheelchair with respect to an occupant sitting in the wheelchair, and that the right side of the wheelchair would be a mirror symmetric with respect to the left side of the wheelchair.

Figure 2:
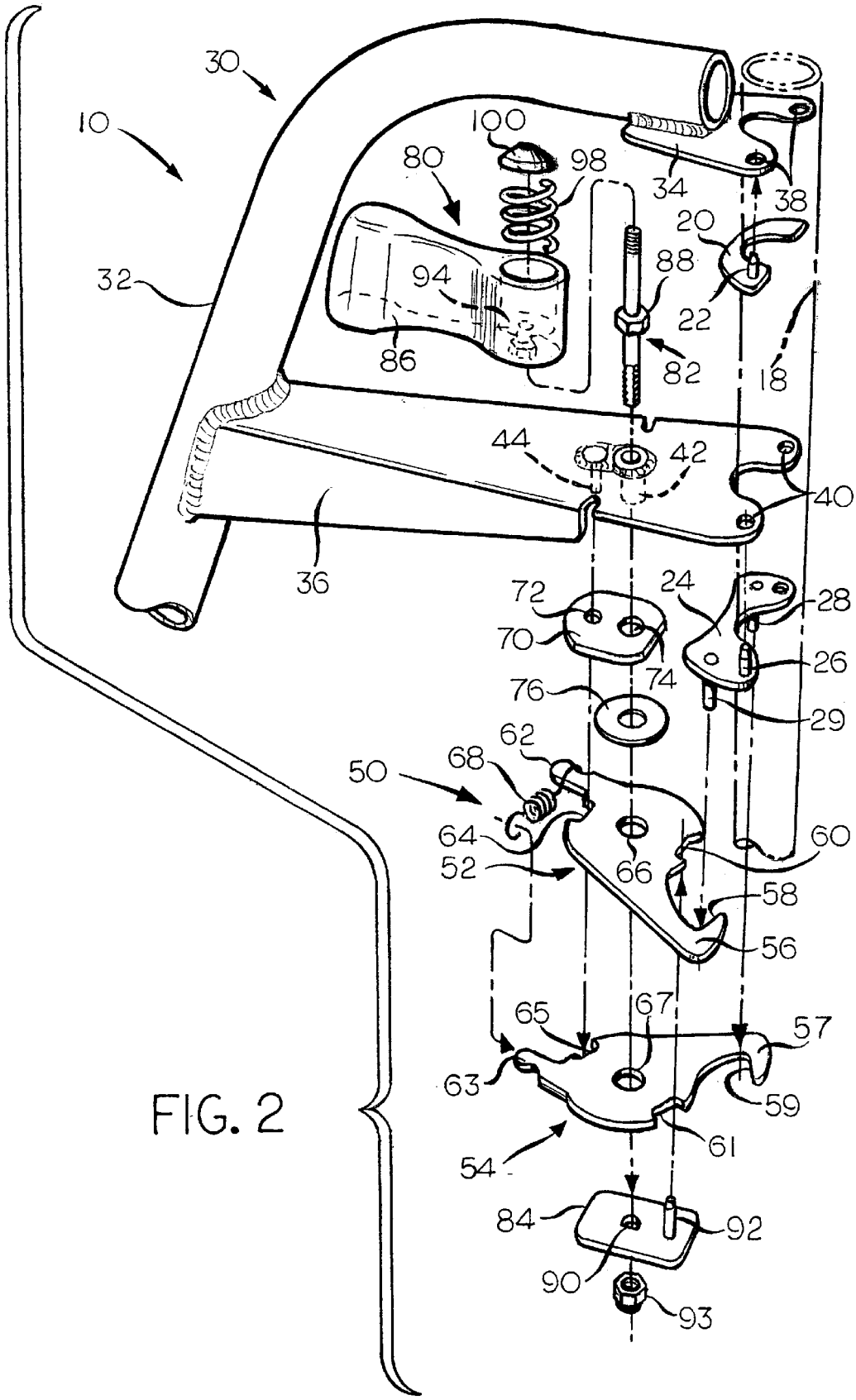
FIG. 2 is an exploded perspective view of the universal footrest bracket assembly according to a preferred embodiment of the invention.
Figure 3:
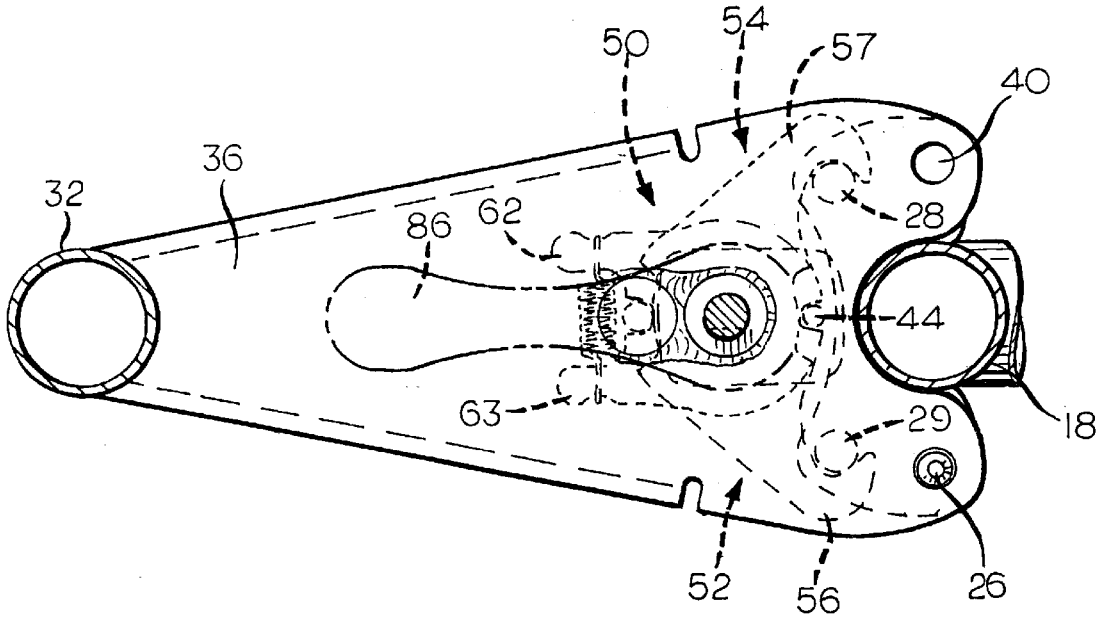
FIG. 3 is a top view of the universal footrest bracket assembly taken along lines 3—3 of FIG. 2 with the latch mechanism shown in phantom in a locked position.

Referring now to FIG. 2, there is illustrated the universal footrest bracket assembly 10 according to the preferred embodiment of the invention. The footrest assembly 10 includes a front tube member 18 (shown in phantom) for attaching the footrest assembly 10 to the frame member 16 using conventional means, such as a threaded fastener and the like. The front tube member 18 may be an integral portion of the wheelchair, if desired. As shown in FIG. 1, the frame member 16 and front tube member 18 include a pair of equally-spaced apertures for allowing a threaded fastener to pass therethrough. The frame member 16 is attached to the frame tube member 14 such that the universal footrest bracket assembly 10 is in a "standard" position. In addition, the frame member 16 includes a second pair of apertures 17 position. When the front tube member 18 is attached to the frame member 16 using the top set of apertures 17, the front tube member 18 is attached to frame member 16 such that the universal footrest bracket assembly 10 is in a "hemi" position. The "hemi" position lowers the relative position of the frame member 16 with respect to the front tube member 18, along with an occupant sitting the in wheelchair, such that the occupant may be able to propel the wheelchair with a capable foot, if desired.

The front tube member 18 includes an upper support plate 20 with an upwardly extending pivot pin 22. The front tube member 18 also includes a lower support plate 24 that is spaced apart from the upper support plate 20 by a predetermined distance. The lower support plate 24 includes an upwardly extending pivot pin 26 and a pair of downwardly extending latch pins 28, 29. Preferably, the pivot pins 22, 26 are in vertical alignment with each other. The upper and lower support plates 20, 24 may be formed integrally with the front tube member 18 or may be attached to the front tube member 18 using means well known in the art, such as welding, brazing, and the like. It should be noted that for the left side of the wheelchair with respect to an occupant sitting in the wheelchair, both the pivot pins 22, 26 are located on the left side of the front tube member 18 as shown in FIG. 2. In addition, it should be readily apparent that for the right side of the wheelchair, the pivot pins 22, 26 would be located on the right side of the front tube member 18.

The universal footrest bracket assembly 10 also includes an upper footrest tube assembly, shown generally at 30. The upper footrest tube assembly 30 includes a footrest support tube 32 having an upper pivot plate 34 and a lower pivot plate 36. The upper and lower pivot plates 34, 36 may be formed integrally with the footrest support tube 32 or may be attached to the footrest support tube 32 using means well known in the art, such as welding, brazing, and the like. The upper and lower pivot plates 34, 36 are formed having respective pairs of apertures or pivot holes 38, 40 that are in substantial vertical alignment with each other and with the pivot pins 22, 26. Each of the pivot holes 38, 40 has a diameter sufficiently large such that the pivot pins 22, 26 can be received in the pivot holes 38, 40 to pivotally mount the upper footrest tube assembly 30 to the support plates 20, 24 attached to the front tube member 18.

Preferably, the predetermined distance between the upper and lower pivot plates 34, 36 is approximately equal to the predetermined distance between the upper and lower support plates 20, 24 such that the support plates 20, 24 can support the pivot plates 34, 36 when the pivot pins 22, 26 are received in the pivot holes 38, 40. The lower pivot plate 36 also includes a hollow sleeve 42 (shown in phantom) and a stop pin 44 (shown in phantom), both extending downwardly a predetermined distance from the lower pivot plate 36.

The upper footrest tube assembly 30 also includes a latch mechanism, shown generally at 50, for locking the universal footrest bracket assembly 10 in a predetermined position relative to the frame 16 of the wheelchair. The latch mechanism 50 includes an upper latch member 52 and a lower latch member 54. The lower latch member 54 can be mirror symmetric to the upper latch member 52, that is, substantially identical to the upper latch member 52 when it is turned upside down. In this manner, inventory is reduced, and the cost of manufacture is reduced.

Each latch member 52, 54 includes a generally C-shaped latch portion 56, 57 forming a latch seat 58, 59 for engaging the downwardly-extending latch pins 28, 29 located on the lower support plate 24. A first cam surface 60, 61 is located adjacent each of the C-shaped latch portions 56, 57 of the latch members 52, 54. The purpose of the cam surfaces 60, 61 will be discussed below. Each latch member 52, 54 also includes an outwardly extending tab portion 62, 63 located on the opposite side of the C-shaped latch portion 56, 57. A second cam surface 64, 65 is located adjacent the tab portion 62, 63 for engaging the stop pin 44 extending downwardly from the lower pivot plate 36. An alignment hole 66, 67 for aligning the latch members 52, 54 in the vertical direction is located in approximately the central portion of each latch member 52, 54. A spring 68 may be used to bias the tab portions 62, 64 towards each other. A spacer plate 70 is located between the lower pivot plate 36 and the upper latch member 52 to position the upper latch member 52 a predetermined distance from the lower pivot plate 36. Preferably, the thickness of the spacer plate 70 is approximately equal to the thickness of the lower support plate 24. The spacer plate 70 includes a pair of an apertures 72, 74 for allowing the stop pin 44 and the sleeve 42 to pass therethrough, respectively. In addition, a washer 76 may be positioned between the spacer plate 70 and the upper latch member 52 to properly position the upper latch member 52 in the vertical direction with respect to the latch pins 28, 29. When assembled, the sleeve 42 passes through the aperture 74, the washer 76, and the alignment holes 66, 67 on the upper and lower latch members 52, 54. Likewise, the stop pin 44 passes through the aperture 72 to engage the second cam surfaces 64, 65 of the upper and lower latch member 52, 54.

The upper footrest tube assembly 30 also includes a release mechanism, shown generally at 80, for locking and unlocking the latch mechanism 50 of the tube assembly 30. The release mechanism 80 generally includes a release pin 82, a release plate 84, and a release knob 86. Preferably, the release pin 82 is threaded at both ends and includes a seat member 88, such as a hex-shaped nut, located approximately equidistant from both ends of the release pin 82. Alternatively, the release pin 82 may be a clevis pin (not shown) having a roll pin located adjacent the release plate 84 for relative movement therewith. It should be noted that the lower end of the release pin 82 has a flattened surface, thus producing an irregularly-shaped lower end. The release plate 84 includes an irregularly-shaped aperture 90 that is complementary to the irregularly-shaped lower end of the release pin 82, allowing the lower end of the release pin to pass therethrough. The release plate 84 also includes a latch pin 92 of sufficient length for engaging the first cam surfaces 60, 61 of the upper and lower latch members 54, 56. In addition, the lower end of the release pin 82 is of sufficient length to allow the lower end of the release pin 82 to pass through the sleeve 42, the spacer plate 72, the washer 76, the upper latch member 52, the lower latch member 54, and the release plate 84 such that a fastener 93, such as a lock nut, can be threaded onto the lower end of the release pin 82.

The release knob 86 preferably includes an opening 94 at one end thereof. The lower end of the opening 94 (shown in phantom) is complementary in shape to the hex-shaped nut 88 such that the it can be seated in the opening 94 to operatively connect the release pin 82 to the release knob 86. It should be realized that turning the release knob 86 in one direction causes the release plate 84 to turn in the same direction. A spring 98 may be inserted into the opening 94 to exert a downward bias on the release knob 86. A fastener, such as a lock nut 100, may be threaded onto the release pin 82 to cause the spring 98 to exert the downward bias against the release knob 86 and to seat the nut 88 in the lower end of the release knob 86.

As shown in FIG. 2, the release knob 86 is oriented such that the release knob 86 is pointing in a forward orientation. However, because the hex-shaped nut 88 is received in the complimentary-shaped recess in the lower end of the release knob 86, the bracket assembly 10 has the ability to position the release knob 86 in six different orientations that can be selected by the user. This can be accomplished by pulling the release knob 86 in an upward direction until the release knob 86 clears the hex-shaped nut 88, rotating the release knob 86 to the desired orientation and then releasing the release knob 86 such that the bias of the spring 74 causes the nut 88 to again be received in the opening 94 of the release knob 86. It should be appreciated that the invention is not limited by the number of different orientations that the release knob 86 can be positioned by user, and that the invention can be practiced using any shape for the recess and any complimentary shape for the nut.

As mentioned earlier, the universal footrest bracket assembly 10 can be mounted to either the left or right side of the wheelchair, as determined by the location of the pivot pins 22, 26. For example, as shown in FIG. 2, when the pivot pins 22, 26 are located on the left side of the wheelchair with respect to the occupant sitting in the wheelchair, the universal footrest bracket assembly 10 can be used for a left footrest by placing the pivot pins 22, 26 into the left pivot holes 38, 40. Likewise, when the pivot pins 22, 26 are located on the right side of the wheelchair with respect to the occupant sitting in the wheelchair, the universal footrest bracket assembly 10 can be used for a right footrest by placing the pivot pins 22, 26 into the right pivot holes 38, 40. In both instances, the universal footrest bracket assembly 10 can then be swung into a locked position by pivoting the universal footrest bracket assembly 10 until the latch mechanism 50 locks the universal footrest bracket assembly 10 into a forward position.

Figure 4:
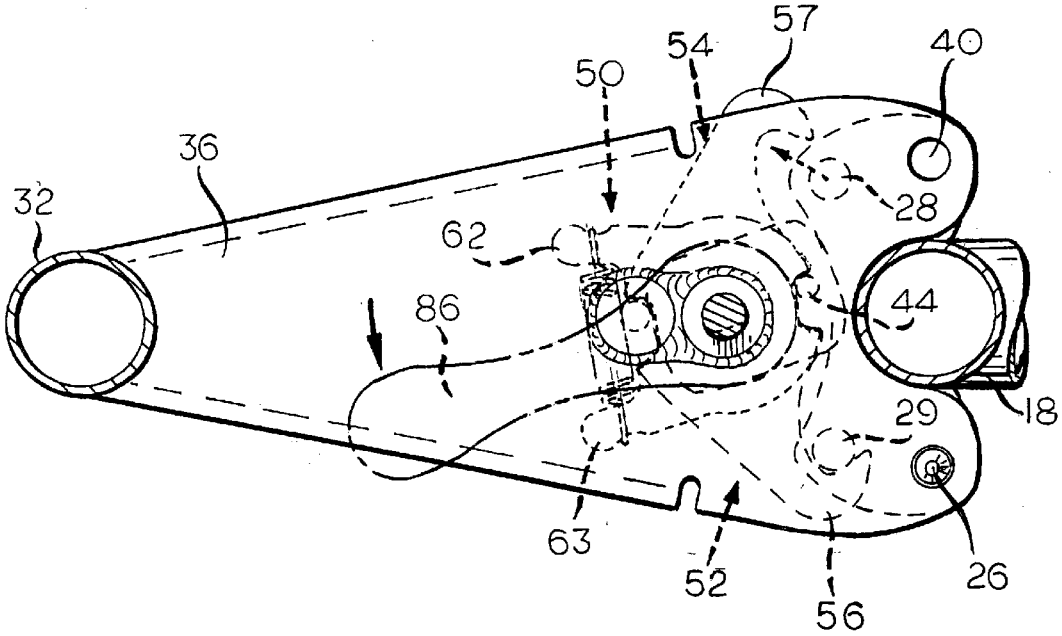
FIG. 4 is a top view of the universal footrest bracket assembly taken along lines 3—3 FIG. 2 with the latch mechanism shown in phantom in a unlocked position.
Figure 5:
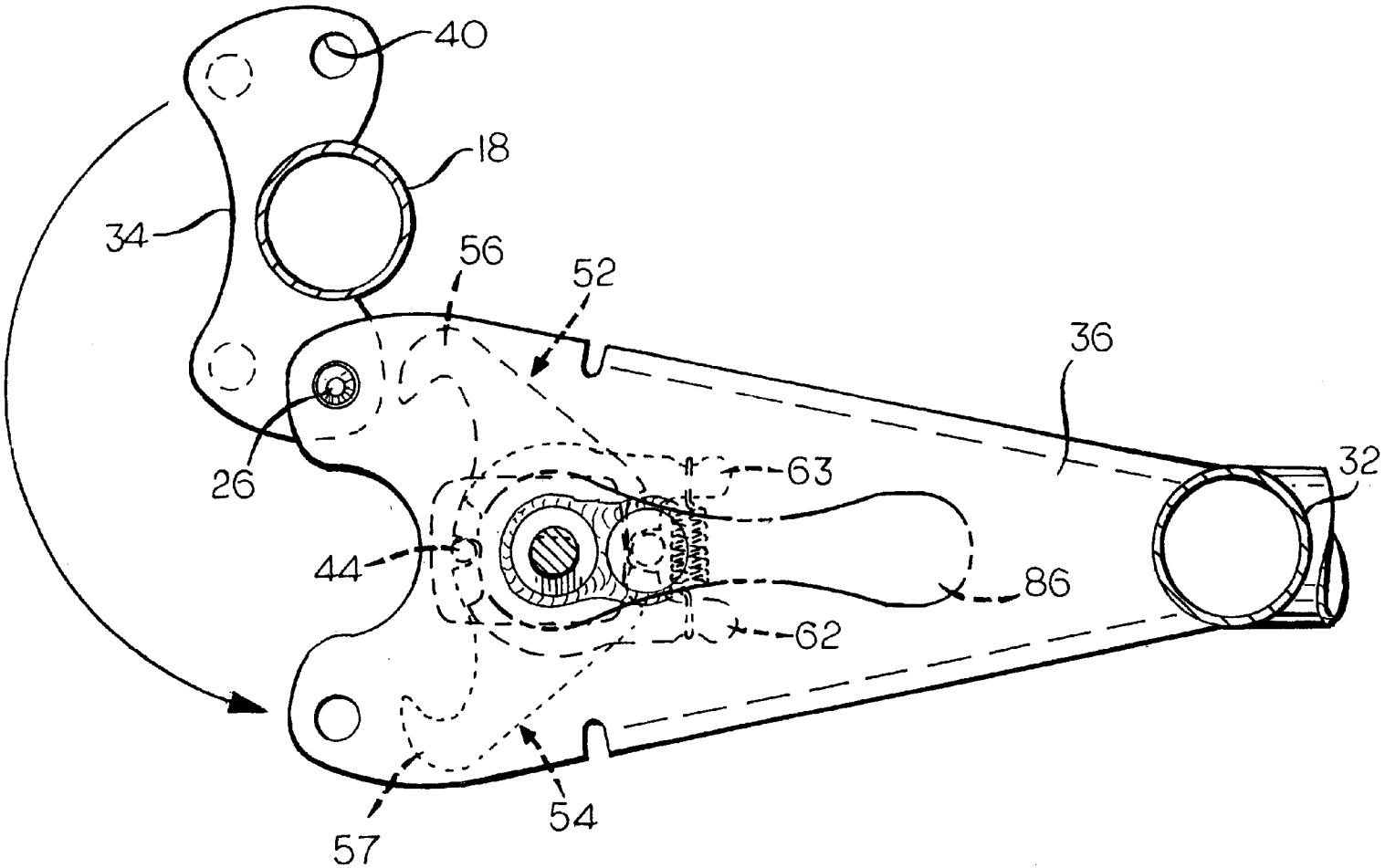
FIG. 5 is a top view of the universal footrest bracket assembly taken along lines 3—3 of FIG. 2 with the latch mechanism shown in phantom in an unlocked position and the universal footrest bracket assembly has been swung away from the wheelchair.

For the universal footrest bracket assembly 10 shown in FIGS. 2 through 5, this is accomplished by initially pivoting the universal footrest bracket assembly 10 in a clockwise direction (when looking downwardly) relative to the upper footrest rube assembly 30. As the universal footrest bracket assembly 10 continues to pivot, the latch pin 25 engages the outer surface of the C-shaped latch portion 57, causing the lower latch member 54 to move outwardly against the bias of the spring 68. Because the upper and lower latch members 52, 54 are capable of independent pivotal movement, the upper latch member 52 remains stationary, while the lower latch member 54 pivots upon engagement of the latch pin 29. As the universal footrest bracket assembly 10 continues to pivot, the pivot pin 29 no longer engages the C-shaped latch portion 57. Because of the bias of the spring 68, the lower latch member 54 snaps back such that the latch pin 28 is received within the latch seat 59 in a locked position, as shown in FIG. 4. It should be noted that latch pin 92 engages the cam surfaces 60, 61 of the upper and lower latch members 52, 54 and the stop pin 44 engages the cam surfaces 64, 65 of the upper and lower latch members 52, 54 when the universal footrest bracket assembly 10 is in a locked position. In this locked position, the universal footrest bracket assembly 10 is held securely in place in a forward position. The other universal footrest bracket assembly (not shown) can be locked by pivoting it in a counter-clockwise direction (when looking downwardly) relative to the opposite upper footrest bracket assembly (not shown).

Figure 6:
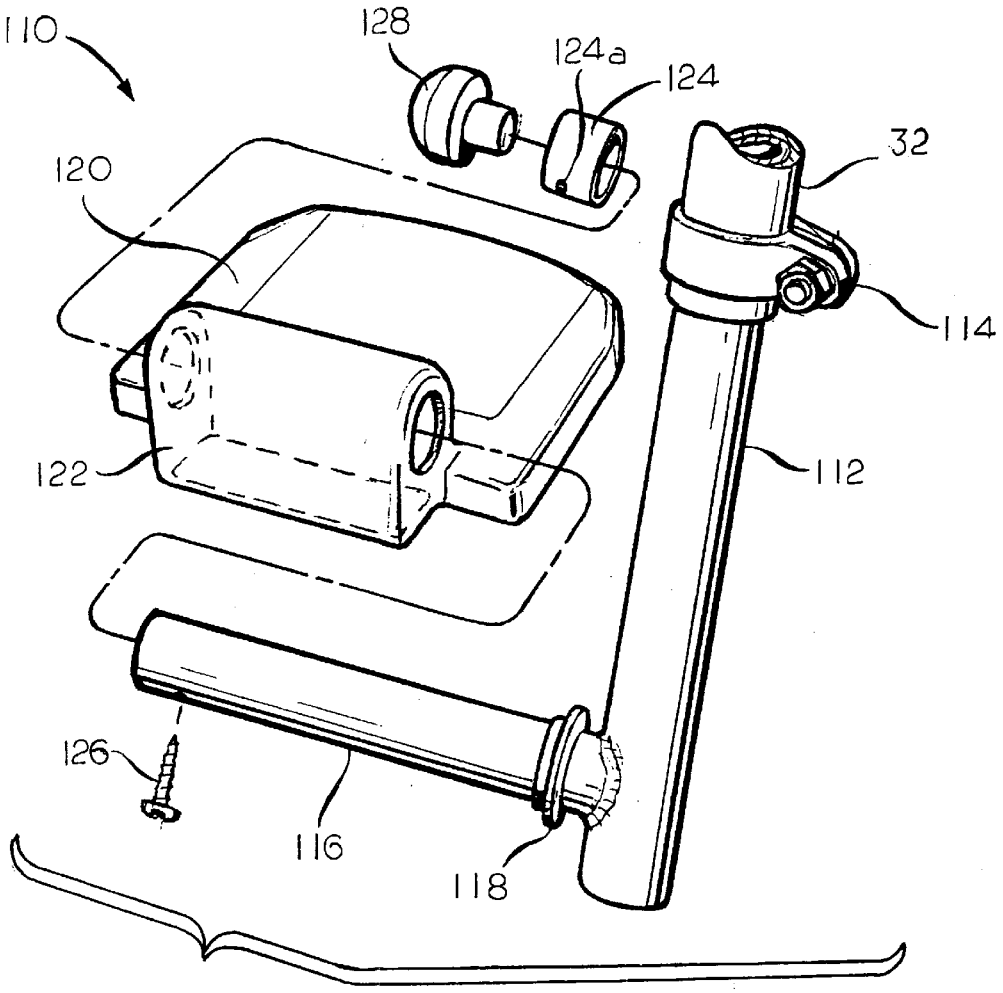
FIG. 6 is an exploded perspective view of the lower footrest support assembly according to the preferred embodiment of the invention.

As mentioned earlier, the release mechanism 80 allows the latch mechanism 30 to be released from its locked position and allows the universal footrest bracket assembly 10 to pivot away from the forward position and be detached from the wheelchair, if desired. When the universal footrest bracket assembly 10 is mounted on the left side of the wheelchair as shown in the drawings, this is accomplished by moving the release knob 86 in the counterclockwise direction indicated by the arrow in FIG. 5. As discussed above, movement of the release knob 86 causes the release plate 84 to move in the same direction. As a result, the latch pin 92 of the release plate 84 also moves in the same counterclockwise direction. This movement causes the latch pin 92 to engage the cam surface 61 of the lower latch member 54 an pivot the lower latch member 54 in the counterclockwise direction until the latch seat 59 no longer engages the latch pin 29 of the lower support plate 24. It should be noted that the stop pin 44 in mating contact with the cam surface 65 of the lower latch member 54, thereby preventing over-rotation of the release knob 86. At this point, the universal footrest bracket assembly 10 can be pivoted away from the wheelchair as illustrated in FIG. 6. After the release knob 84 is released, the bias of the spring 68 causes the lower latch member 54 to pivot in the clockwise direction and the release knob 86 to return to its original position. Subsequently, the universal footrest bracket assembly 10 can be easily detached from the wheelchair by lifting the universal footrest bracket assembly 10 in the upward direction, thereby removing the pivot pins 22, 26 from the pivot holes 38, 40. The other universal footrest bracket assembly (not shown) can be unlocked and pivoted in the clockwise direction in a similar manner.

Referring now to FIG. 6, the universal footrest bracket assembly 10 also includes a lower footrest tube assembly, shown generally at 110. The lower footrest tube assembly 110 includes a lower tube member 112 having an outer diameter that is slightly smaller than the inner diameter of the footrest support tube 32 such that the lower tube member 112 can be inserted into the footrest support tube 32. The lower tube member 112 can be securely positioned with respect to the footrest support tube 32 using any well known means, such as a clamp 114. In this manner, the length of the lower tube member 112 can be selected by the occupant. A footplate tube member 116 may be connected to the lower tube member 112 using means well known in the art, such as welding, brazing, and the like. The footplate tube member 116 includes a flange 118 located near lower tube member 112.

The lower footrest tube assembly 110 also includes a footplate 120 for supporting the foot of the occupant. One end of the footplate 120 has a cylindrical portion 122 having a diameter sufficiently large such that the footplate tube member 116 can be rotatably received in the cylindrical opening 122 of the footplate 120. In this manner, the footplate 120 can be raised or lowered by the occupant. The flange 118 serves as a backstop for the footplate 120 when the footplate tube member 116 is inserted into the cylindrical portion 122. The footplate 120 shown in FIG. 6 is installed on the footplate tube member 116 for use on the left side of the wheelchair with respect to an occupant sitting in the wheelchair. However, the footplate 120 can be installed on the footplate tube member 116 for use on the right side of the wheelchair by inserting the footplate tube member 116 in the opposite direction through the cylindrical opening 122 of the footplate 120. In either event, once the footplate 120 is positioned over the footplate tube member 116 and abutted against the flange 118, a cylindrical sleeve 124 having an inside diameter slightly larger than the outside diameter of the footplate tube member 116 can be placed over the footplate tube member 116 to abut against the footplate 120 to hold the footplate 120 against the flange 118. The sleeve 124 may then be secured to the footplate tube member 116 by a fastening means 126, such as a screw and the like, inserted into one or more holes **124*a* in sleeve 124 and the footplate tube member 116. For aesthetic purposes, a plug 128 may then be inserted into the end of the footplate tube member 116 once the sleeve 124 is secured to the footplate tube member 116**.

It should be appreciated that many variations of mounting the universal footrest bracket assembly 10 to the wheelchair are possible. For example, the support plates 20, 24 can be mounted directly to the front frame of the wheelchair, thereby eliminating the need for the front tube member 18.

In accordance with the provisions of the patent statutes, the principle and mode of operation of this invention have been explained and illustrated in its preferred embodiment. However, it must be understood that this invention may be practiced otherwise than as specifically explained and illustrated without departing from its spirit or scope.

What is claimed is:

1. A footrest assembly for use with a wheelchair, comprising:

a first support plate including a first pivot pin;

a second support plate including a second pivot pin and a pair of latch pins, said first and second support plates adapted to be mounted on a wheelchair with said first and second pivot pins axially aligned;

a footrest support member including a first pivot plate having a pivot hole and a second pivot plate having a pivot hole, said pivot hole of said first pivot plate being capable of receiving said first pivot pin of said first support plate and said pivot hole of said second pivot plate being capable of receiving said second pivot pin of said second support plate for pivotally mounting said footrest support member on said first and second support plates when said first and second support plates are mounted on a wheelchair; and a pair of latch members mounted on said second support plate, each of said latch members having a latch seat, said footrest assembly being in a locked position relative to said second support plate when said latch seat of at least one of said latch members engages at least one of said latch pins, said footrest assembly being in an unlocked position relative to said second support plate when said latch seats do not engage said latch pins.

2. The footrest assembly according to claim 1, and further including a release mechanism mounted on said second pivot plate for cooperating with said pair of latch members, said release mechanism including a spring-biased release knob pivotally attached to said second pivot plate and a release plate having a release pin for cooperating with said pair of latch members.

3. The footrest assembly according to claim 2, wherein said release knob is adapted to be positioned at a plurality of different orientations with respect to a wheelchair on which said support plates are mounted.

4. The footrest assembly according to claim 1, wherein said second support plate further includes a stop pin for engaging said pair of latch members.

5. A universal footrest assembly for a wheelchair having left and right sides, comprising:

a frame tube adapted to be mounted on one of said left and right side a of a wheelchair;

a first support plate mounted on said frame tube, said first support plate including a first pivot pin;

a second support plate mounted on said frame tube, said second support plate including a second pivot pin, said second pivot pin being in vertical alignment with said first pivot pin; and a footrest support member having a first pivot plate with a first pair of pivot holes and a second pivot plate with a second pair of pivot holes being in vertical alignment with the first pair of pivot holes of said first pivot plate, wherein said footrest assembly is capable of being positioned on a left side of a wheelchair to which said frame tube is mounted by positioning said footrest support member such that the first pivot pin of said first support plate is received in one of said first pair of pivot holes of said first pivot plate, and such that the second pivot pin of said second support plate is simultaneously received in one of said second pair of pivot holes of said second pivot plate, wherein said footrest assembly is capable of being positioned on the right side of the wheelchair to which said frame tube is mounted by positioning said footrest support member such that the first pivot pin of first support plate is received in the other one of said first pair of pivot holes of said first pivot plate, and such that the second pivot pin of said second support plate is simultaneously received in the other one of said second pair of pivot holes of said second pivot plate, a pair of latch pins extending downwardly from said second support plate, and a latch mechanism operatively connected to said second pivot plate, said latch mechanism including a pair of spring-biased latch members, each latch member having a latch seat for cooperating with one of said pair of latch pins, a first cam surface and a second cam surface, and a stop pin mounted on said second pivot plate for cooperating with the second cam surface of each latch member.

6. The footrest assembly according to claim 5, further including a release mechanism for releasing said latch mechanism from a locked position.

7. The footrest assembly according to claim 6, wherein said release mechanism includes a spring-biased release knob pivotally attached to said second pivot plate, and a release plate operatively connected to said release knob.

8. The footrest assembly according to claim 7, wherein said release plate includes a release pin which cooperates with said first cam surface of said pair of latch members.

9. The footrest assembly according to claim 7, wherein said release knob is adapted to be positioned at a plurality of different orientations with respect to a wheelchair on which said frame tube is mounted.

10. A universal footrest assembly for a wheelchair having a front, left and right sides and a front tube member mounted on one of the left and right sides adjacent the front, comprising:

an upper footrest assembly comprising an upper support plate adapted to be mounted on the front tube member; a lower support plate adapted to be mounted on the front tube member in a vertically-aligned, spaced-apart relationship with said upper support plate; and an upper footrest support member having an upper pivot plate and a lower pivot plate in a vertically aligned, spaced-apart relationship with said upper pivot plate, means on said upper and lower support plates adapted to pivotally support said upper and lower pivot plates, respectively, on said upper and lower support plate whereby said universal footrest assembly can pivot between a position to the front of a wheelchair and a position towards an adjacent side of the wheelchair;

a lower footrest tube assembly including a lower footrest support member connected to said upper footrest support member, an outwardly extending tube member connected to a lower end of said lower footrest support member; and a footrest removably attached to said tube member; and a latch mechanism mounted on one of said upper and lower pivot plates, said latch mechanism includes a pair of spring-biased latch members, at least one of said latch members being adapted to releasably engaging one of said support plates to prevent said footrest assembly from pivoting from a position to the front of a wheelchair to a position towards an adjacent side of the wheelchair.

11. The footrest assembly according to claim 10, wherein said upper and lower support plates each include at least one pivot pin, wherein said upper and lower pivot plates each include at least one pivot hole, and wherein said upper footrest support member is pivotally mounted on said upper and lower support plates when a pivot pin of said upper support plate is received in a pivot hole of said upper pivot plate and a pivot pin of said lower support plate is received in a pivot hole of said lower pivot plate.

12. The footrest assembly according to claim 10, and wherein the support plate which supports the pivot plate which mounts said latch mechanism includes a pair of latch pins, and wherein each latch member has first and second cam surfaces and a latch seat for cooperating with a latch pin of said pair of latch pins, and a stop pin for cooperating with the second cam surface of each latch member.

13. The footrest assembly according to claim 12, and farther including a release mechanism mounted to release said latch mechanism.

14. The footrest assembly according to claim 13, and wherein said release mechanism includes a spring-biased release knob pivotally attached to the pivot plate which mounts said latch mechanism, and a release plate having a release pin for cooperating with said pair of latch members.

15. The footrest assembly according to claim 14, wherein said release knob is adapted to be positioned at a plurality of different orientations with respect to a wheelchair on which said upper and lower support plates are mounted.

* * * * *